US005537691A

United States Patent [19]

Inzer

[11] Patent Number: 5,537,691

[45] Date of Patent: Jul. 23, 1996

[54] WEIGHTLIFTING SUIT HAVING CONTOURED LEG LOWER EDGE

[76] Inventor: John W. Inzer, C/O Inzer Advance Designs, Inc., P.O. Box 2981, Longview, Tex. 75606

[21] Appl. No.: 232,476

[22] Filed: Apr. 25, 1994

[51] Int. Cl.[6] ..... A41D 1/08

[52] U.S. Cl. ..... 2/69

[58] Field of Search ..... 2/69, 227, 238, 2/228, 400–407, 79, 80, 243.1, 255, 274, 275, 67, 78.1, 78.2, 78.3, 73, 2.15, 2.16; D2/731, 732, 738, 742, 743; 482/105, 106; 112/141, 423, 424

[56] References Cited

U.S. PATENT DOCUMENTS

| | | | |
|---|---|---|---|
| D. 81,135 | 5/1930 | Hollingsworth | D2/731 |
| D. 305,375 | 1/1990 | Beggs . | |
| 2,073,929 | 3/1937 | Goldstein . | |
| 4,710,978 | 12/1987 | Pankopf . | |
| 4,894,867 | 1/1990 | Ceravolo et al. . | |
| 4,896,379 | 1/1990 | Kape . | |
| 5,010,596 | 4/1991 | Brown et al. . | |
| 5,033,117 | 7/1991 | Fairweather | 2/227 |
| 5,046,194 | 9/1991 | Alaniz et al. . | |

*Primary Examiner*—C. D. Crowder
*Assistant Examiner*—Gloria Hale
*Attorney, Agent, or Firm*—Killworth, Gottman, Hagan & Schaeff

[57] ABSTRACT

A weightlifting suit including a pair of leg sections terminating in leg openings is provided. The leg openings slope from an inner thigh section located on the inside of the wearer's thigh to an outer thigh section generally located on the outside of the wearer's thigh. The leg sections may taper from upper openings generally encasing the upper portions of the thighs to the leg openings. Hems rolled to the outside of the suit away from the thighs of the wearer may be provided around the leg openings.

14 Claims, 3 Drawing Sheets

WEIGHTLIFTING SUIT HAVING CONTOURED LEG LOWER EDGE

BACKGROUND OF THE INVENTION

The present invention relates generally to weightlifting suits for individuals who lift weights for pleasure, exercise or in competition, and more particularly, to a relatively comfortable weightlifting suit which reduces the sliding of the suit on the legs of the individual during a lift to provide increased support and stability.

During powerlifting competitions, and oftentimes during general weightlifting exercises, a lifter wears a specially designed weightlifting suit to provide increased support and stability for the weightlifter's body such that a maximum amount of weight can be safely lifted. Since powerlifting is considered a specialized activity within the extensive genre of weightlifting, the term weightlifting should be considered to include powerlifting and any other exercises in which weights are lifted.

In an effort to ensure fair and uniform weightlifting competitions, national and international governing bodies have adopted rules and regulations which set forth provisions governing the design and construction of weightlifting suits. For example, the 1993 United States Powerlifting Federation Pocket Rule Book, at Section II, page 5, includes rules governing the construction of the crotch, the appearance of the suit, alterations to the suit, and the length of the suit legs.

Typically, lifting suits are fabricated from a sturdy, somewhat stiff, heavy fabric which has a very small degree of stretch. However, to provide the appropriate support and assistance to the lifter, the fabric must have good comeback or springback. In other words, the fabric must readily, and rather forcefully, return to its original shape after being stretched.

A weightlifting suit is normally worn very tight on the lifter to provide the desired support during a lift, such as a squat or deadlift. The tightness and the properties of the suit material have a pulling or pushing effect on the body which tends to force the lifter into an erect position. This force aids the lifter during a squat or deadlift since the lifter, in each instance, ascends from a crouched position into a standing position. Further, such weightlifting suits have been shown to reduce the chance of injury by providing added support and stability to the muscles during the lifting movement.

To assure the most efficient transfer of the comeback force generated by the suit to the lifter, the suit must remain fixed to the body of the lifter throughout the lift However during a lift, conventional weightlifting suits typically slip and slide on the lifter. For instance, during the descent into a full squat position or a starting deadlift position, the legs of the weightlifting suit tend to slide upward on the legs of the lifter towards the buttocks. This sliding action causes looseness or slack in the hip and buttocks area of the lifter and, thus reduces the effectiveness of the suit. Since the hips and buttocks area is the main hinge point of the body during the squat and deadlift, support in this area is critical to maximum performance of these lifts.

Various attempts have been made to increase the comeback force generated by a weightlifting suit during a lift. For example, U.S. Pat. No. 5,046,194, issued to Alaniz et al., discloses a weightlifting suit having a plurality of seams which create a harness or supporting seat into which the lifter sits during a squatting movement. The seams are preferably constructed of overlap material from contiguous fabric panels and are, therefore, twice as thick as the single ply material of the suit. This permits the seams to store more energy during the lifting movement. However, neither Alaniz et al. nor any other prior weightlifting suits have been designed to reduce the loss in support and stability due to slipping and sliding of the suit in preparation for and during a lift.

It is thus apparent that a need exits for a weightlifting suit which reduces the slipping and sliding of the on the legs of the lifter to provide increased support and stability while providing a comfortable fit.

SUMMARY OF THE INVENTION

This need is met by the weightlifting suit in accordance with the present invention wherein leg openings of the suit evenly slope from inner thigh sections to outer thigh sections such that the outer thigh sections extend below the inner thigh sections on the wearer. The leg sections may also taper from an upper opening to the leg opening to provide a tight fit at the leg opening. A hem rolled to the outside of the suit away from the thigh of the wearer may be provided around the leg opening to reinforce the material.

In accordance with one aspect of the present invention, a weightlifting suit has a pair of leg sections for encasing at least a portion of the thighs of a wearer. Each of the leg sections include an upper opening for generally encasing the upper portion of the thigh of the wearer and terminate in a leg opening. The leg opening has an inner thigh section located generally on the inside of the thigh of the wearer and an engaging section extending from the inner thigh section around the thigh of the wearer. To provide increased support and a more comfortable fit, at least a portion of the engaging section extends below the inner thigh section on the thigh of the wearer.

A torso section may be attached to the pair of leg sections for encasing at least a portion of the torso of the wearer. In accordance with powerlifting rules, the leg sections and the torso section may be of a single ply of fabric.

Preferably, the engaging section of the leg opening includes an outer thigh section located generally on the outside of the thigh of the wearer and extending below the inner thigh section on the thigh of the wearer. The leg opening may evenly slope from the inner thigh section to the outer thigh section. Each of the leg sections may taper from the upper opening to the leg opening such that the upper opening has a larger diameter than the leg opening. In addition, the leg opening may include a hem rolled to the outside of the suit away from the thigh of the wearer.

In accordance with another aspect of the present invention, a weightlifting suit is provided having a pair of leg sections for encasing the thighs of a wearer. Each of the leg sections has an upper portion for generally encasing the upper portion of the thigh and terminating in a leg opening. To provide a tight fit at the leg opening, the upper portion has a larger diameter than the leg opening.

Preferably, the leg section evenly tapers from the upper portion to the leg opening. The leg opening may include a hem rolled to the outside of the suit generally away from the thigh of the wearer.

In accordance with yet another aspect of the present invention, a weightlifting suit has a pair of leg sections for encasing the thighs of a wearer. Each of the leg sections terminates in a leg opening having a hem rolled to the outside of the suit away from the thigh of the wearer. The weightlifting suit may include a torso section including a plurality of shoulder straps for encasing at least a portion of the torso of the wearer.

These and other features and advantages of the present invention will become apparent from the following detailed description, the accompanying drawings and the appended claims.

DETAILED DESCRIPTION OF THE PREFERRED EMBODIMENTS

Figure 1:
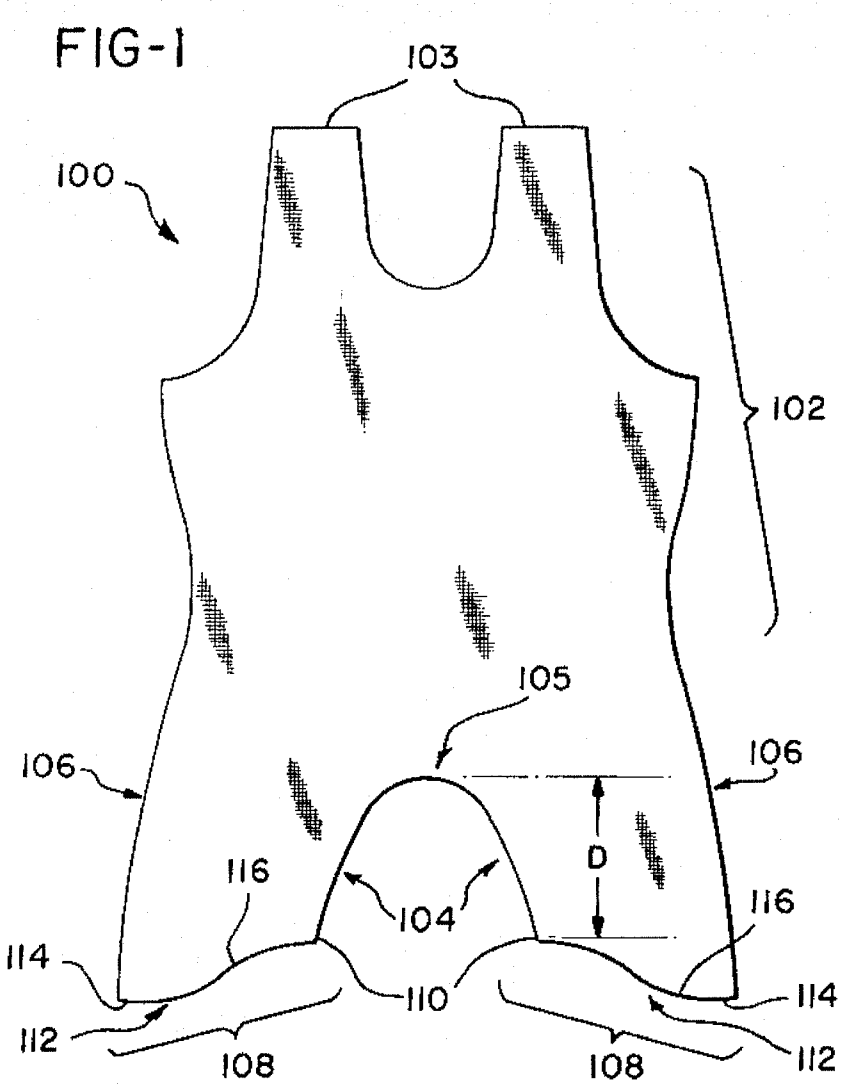
FIG. 1 is a front view of a weightlifting suit having a pair of leg sections terminating in uneven leg openings in accordance with one embodiment of the present invention.

A weightlifting suit 100 having a torso section 102 for encasing at least a portion of the torso of a wearer and a pair -of leg sections 104, attached to the torso section 102, for encasing at least a portion of the thighs of the wearer in accordance with the present invention is shown in FIG. 1. The torso section 102 has a pair of shoulder straps 103 for engaging the shoulders of the wearer. As should be understood, however, the torso section 102 may have full shoulders with short or long sleeves. As required in the 1993 United States Powerlifting Federation Pocket Rule Book, at Section II, rule 1A, the torso section 102 and leg sections 104 may be constructed of a single ply of fabric.

The leg sections 104 have a crotch section 105 and an upper opening 106 for generally encasing the upper portion of the wearer's thigh. Each of the leg sections 104 terminates in a leg opening 108 which encompasses the wearer's thigh. The leg openings 108 have an inner thigh section 110 located generally on the inside of the thigh of the wearer and an engaging section 112 extending around the thigh of the wearer. More particularly, the engaging section 112 includes an outer thigh section 114 located generally on the outside of the thigh of the wearer.

The technical rules of the national and international governing bodies of powerlifting, as set forth in the 1993 United States Powerlifting Federation Pocket Rule Book, at Section II, rule 1B(4) require that the length of the leg on a lifting suit not exceed 15 cm (5⅞") from the middle of the crotch 105 to the edge of the inner thigh section 110 of the leg opening 108, shown as distance D.

To provide better assistance during an lift and a more comfortable fit, at least a portion of the engaging section 112 extends below the inner thigh section 110 on the thigh of the wearer. Preferably, the outer thigh section 114 extends below the inner thigh section 110, however, the front thigh section 116 or the back thigh section of the leg opening 108 may also advantageously extend below the inner thigh section 110. The leg opening 108 may slope from the inner thigh section 110 to the outer thigh section 114 in the manner shown in the drawings.

By increasing the length of the leg section 104 in the outer thigh, front thigh or back thigh areas, the overall contact area between the thigh and the leg section is increased thereby increasing the resistance to sliding and slipping of the suit material on the thigh and buttock area. Concomitantly, the length D between the crotch 105 and the inner thigh section 110 of the leg opening 108 may be made to comply with the powerlifting rules.

The increased length of the engaging section 112 of the leg opening 108 also increases the comfort of the weightlifting suit 100. The larger contact area afforded by the elongated engaging section 112 allows the stress generated in the leg section 104 to be distributed over a larger area. The restriction of the blood flow in the lifter's leg is thereby reduced to provide more comfort.

Figure 2:
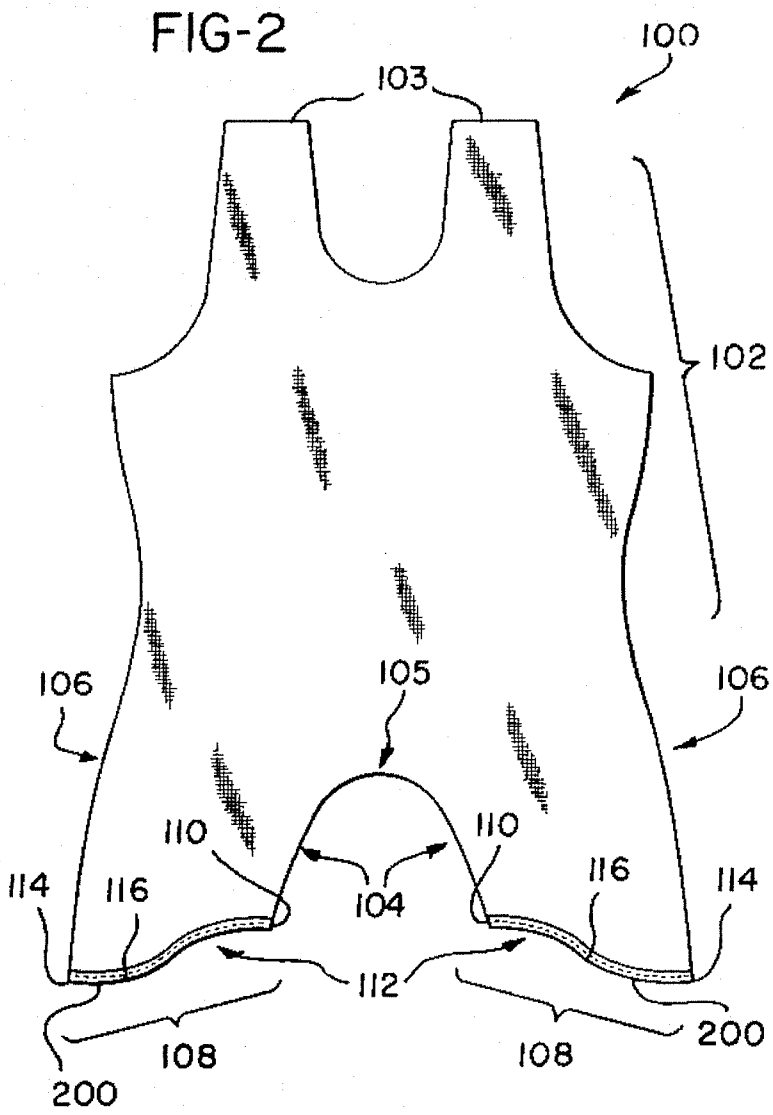
FIG. 2 is a front view of a weightlifting suit having a hem rolled to the outside of the suit away from the wearer in accordance with a second embodiment of the present invention.

As shown in FIG. 2, the weightlifting suit 100 may have a hem 200 sewn around the leg opening 108 to provide structural rigidity and reduce fraying of the material. The hem 200 is preferably rolled to the outside of the weightlifting suit 100 away from the thigh of the wearer. By rolling the hem 200 to the outside of the suit 100, the hem 200 is not pressed into the thigh of the wearer and, therefore, provides a more comfortable fit than conventional weightlifting suits having hems rolled inward. Although shown in FIG. 2 on a weightlifting suit having leg sections of uneven length, it should be understood that the hem 200 may also be advantageously employed in other weightlifting suits, such as those having leg sections of even length.

Figure 3:
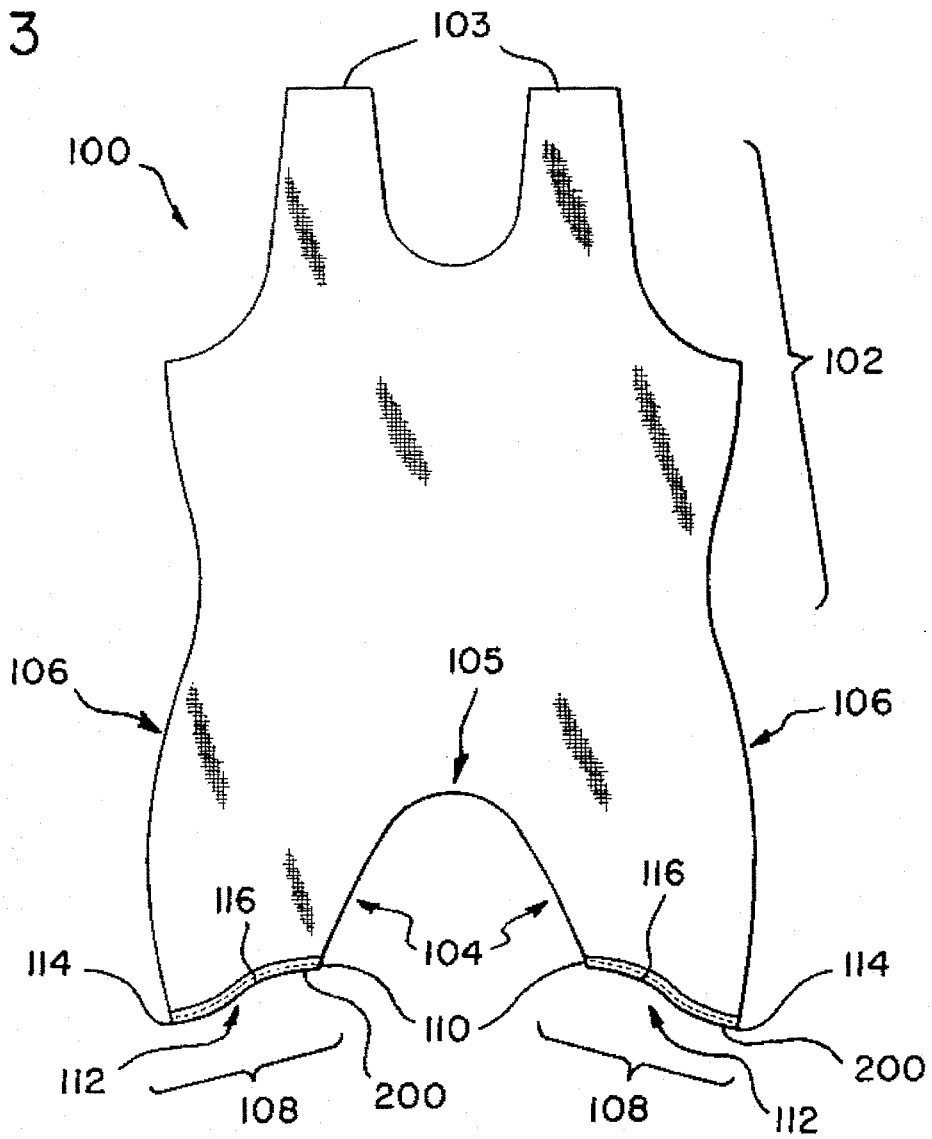
FIG. 3 is a front view of a weightlifting suit having tapered leg sections in accordance with a third embodiment of the present invention.
Figure 4C:
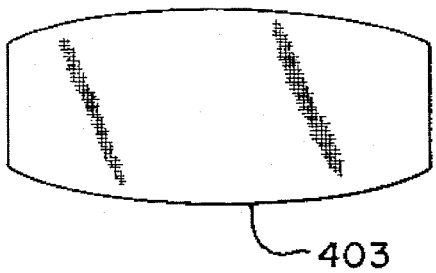
FIGS. 4A through 4C show the front body piece, back body piece and crotch piece, respectively, which may be sewn together to form the present invention.
Figure 4B:
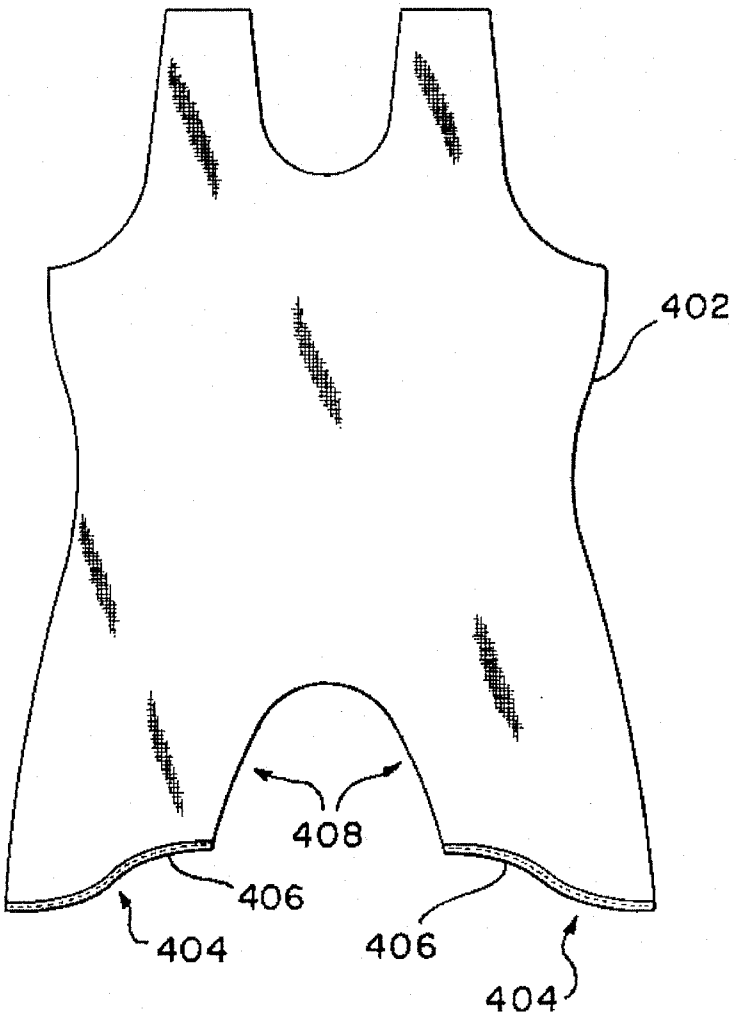
Figure 4A:
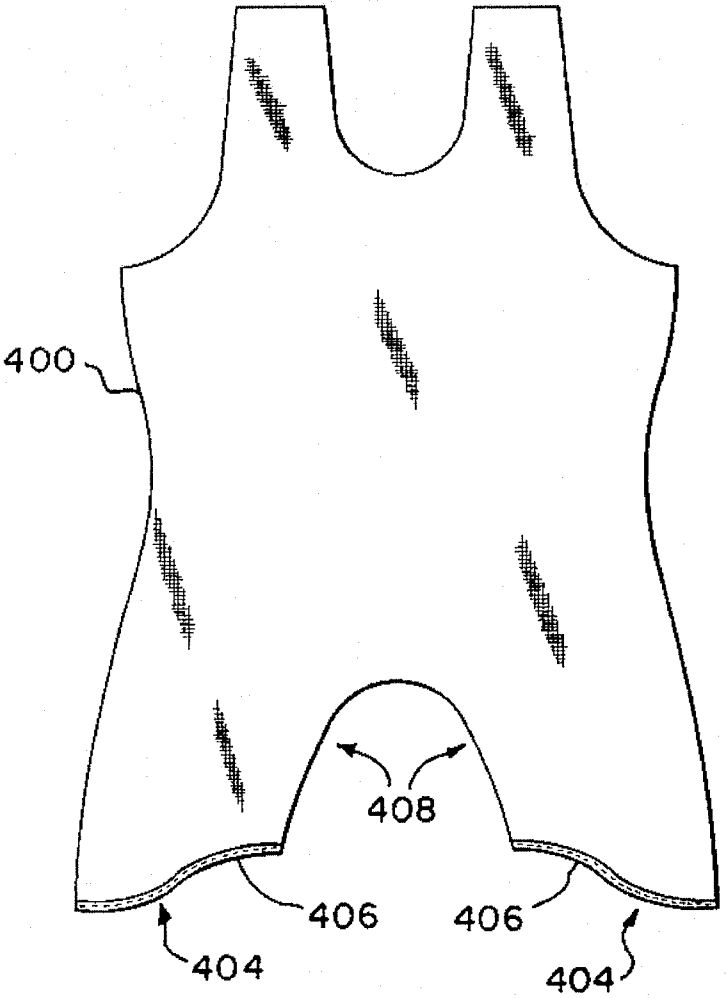

To further reduce the sliding and slipping of the leg section 104 of the weightlifting suit 100 on the thigh and buttock area of the wearer, the leg section 104 may taper from the upper opening 106 to the leg opening 108, as shown in FIG. 3. Consequently, the upper opening 106 has a larger diameter than the leg opening 108. The tapered leg section 104 produces a tight fit at the leg opening 108 which reduces the sliding and slipping of the leg section 104 up the thigh.

The weightlifting suit of the present invention is preferably constructed of three material pieces. Front and back body pieces 400 and 402 are sewn to one another to form the body of the suit. A crotch piece 403 is sewn into the crotch of the suit for added reinforcement. The front and back body pieces 400 and 402 may be fabricated with uneven leg openings 404, outside rolled hems 406 and tapered leg sections 408 as described above in accordance with the invention.

Having thus described the invention in detail by way of reference to preferred embodiments thereof, it will be apparent that other modifications and variations are possible without departing from the scope of the invention defined in the appended claims.

What is claimed is:

1. A weightlifting suit comprising, a pair of leg sections for engaging at least a portion of the thighs of a wearer, each of said leg sections including an upper opening for generally encasing the upper portion of the thigh of said wearer and terminating in a leg opening having an inner thigh section located generally on the inside of the thigh of said wearer and an engaging section extending from said inner thigh section around the thigh of said wearer, said engaging section including an outer thigh section located generally on the outside of the thigh of said wearer, said engaging section extending below said inner thigh section on the thigh of said wearer from said inner thigh section to said outer thigh section to provide increased resistance to sliding or slipping of said weightlifting suit during the lifting of weights by the wearer.

2. The weightlifting suit as recited in claim 1 further comprising a torso section attached to said pair of leg sections for encasing at least a portion of the torso of said wearer.

3. The weightlifting suit as recited in claim 2 wherein said leg sections and said torso section are of a single ply of fabric.

4. The weightlifting suit as recited in claim 1 wherein each of said leg sections tapers from said upper opening to said leg opening such that said upper opening has a larger diameter than said leg opening.

5. The weightlifting suit as recited in claim 4 wherein said leg opening includes a hem rolled to the outside of said suit away from the thigh of said wearer.

6. The weightlifting suit as recited in claim 1 wherein said leg opening evenly slopes from said inner thigh section to said outer thigh section.

7. The weightlifting suit as recited in claim 6 wherein each of said leg sections tapers from said upper opening to said leg opening such that said upper opening has a larger diameter than said leg opening.

8. The weightlifting suit as recited in claim 7 wherein said leg opening includes a hem rolled to the outside of said suit away from the thigh of said wearer.

9. The weightlifting suit as recited in claim 1 wherein said leg opening includes a hem rolled to the outside of said suit away from the thigh of said wearer.

10. A weightlifting suit comprising, a pair of leg sections and a crotch section for encasing the thighs of a wearer, each of said leg sections having an upper portion for generally encasing the upper portion of the thigh and terminating in a leg opening, said upper portion having a larger diameter than said leg opening, said leg section having an inner thigh section located generally on the inside of the thigh of said wearer and an engaging sction extending from said inner thigh section around thee thigh of said wearer, said engaging section including an outer thigh section located generally on the outside of the thigh of said wearer, said inner thigh section being a predetermined distance below said crotch section and said engaging section being below said crotch section a distance greater than said predetermined distance to provide increased resistance to sliding or slipping of said weightlifting suit during the lifting of weights by the wearer.

11. The weightlifting suit as recited in claim 10 wherein each of said leg sections evenly tapers from said upper portion to said leg opening.

12. The weightlifting suit as recited in claim 10 further comprising a torso section attached to said leg sections for encasing at least a portion of the torso of said wearer.

13. The weightlifting suit as recited in claim 12 wherein said leg sections and said torso section are of a single ply of fabric.

14. The weightlifting suit as recited in claim 10 wherein said leg opening includes a hem rolled to the outside of said suit generally away from the thigh of said wearer.

* * * * *